United States Patent [19]

Smiltneek

[11] 3,955,608

[45] May 11, 1976

[54] DEBARKING METHOD AND APPARATUS

[76] Inventor: Ralmond J. Smiltneek, P.O. Box 273, Butler, Wis. 53007

[22] Filed: Dec. 16, 1974

[21] Appl. No.: 532,895

[52] U.S. Cl. ..... 144/208 B; 144/311

[51] Int. Cl.[2] ..... B27L 1/00

[58] Field of Search..... 51/163, 164; 144/208 R, 144/208 B, 311; 241/178, 183, 278 R; 259/3

[56] References Cited

UNITED STATES PATENTS

| | | | |
|---|---|---|---|
| 3,020,943 | 2/1962 | Hjärtsäter | 144/208 B |
| 3,272,245 | 9/1966 | Dick et al. | 144/208 B |
| 3,708,001 | 1/1973 | Koskinen | 144/208 B |
| 3,709,268 | 1/1973 | Tuuha | 144/208 B |

*Primary Examiner*—Othell M. Simpson
*Attorney, Agent, or Firm*—Fred Wiviott

[57] ABSTRACT

Logs or tree limb sections to be debarked and a plurality of smaller, higher density impact objects are disposed in a series of interfaced, open-ended cylindrical sections, alternate ones of which have different diameters and are rotated in opposite directions about generally horizontal axes. The cylindrical sections are generally tangent about a point above their rotational axes and their upper ends are inclined slightly to promote migration of the impact objects and wood sections in series through the chambers and for discharging the same from the final chamber. At least the larger diameter sections include conveyers for carrying the impact objects upwardly and for releasing the same for impacting engagement against the wood sections to be debarked and an external conveyer recycles the impact objects from the final to the initial cylindrical section. An air delivery system discharges dislodged bark and other foreign material from the cylindrical sections.

34 Claims, 8 Drawing Figures

DEBARKING METHOD AND APPARATUS

BACKGROUND OF THE INVENTION

This invention relates to a method and apparatus for debarking tree sections.

There is a substantial need for fuller utilization of pulp wood in view of increasing demand and resource limitations. At present, processing losses may account for up to 70% of a tree cut. To a substantial degree, these losses have resulted from the inability of existing equipment to debark both relatively large logs and relatively smaller limb sections or treetops. The tendency, therefore, was to employ log debarking equipment and to discard the smaller tree limb portions. In the pulp and paper industry, efficient bark removal is especially important because only small quantities of bark can be tolerated in the pump mixture. For example, approximately 4% is the upper limit of bark content that will be accepted by both pulp mills.

SUMMARY OF THE INVENTION

It is a general object of the invention to provide an improved debarking method and apparatus.

Another object of the invention is to provide a debarking apparatus and method which is capable of debarking both logs and relatively smaller tree limb and top sections.

A further object of the invention is to provide a substantially continuous debarking method and apparatus capable of processing tree sections of various sizes.

A further object of the invention is to provide a debarking apparatus and method which is independent of the size and shape of the tree segments to be debarked.

These and other objects and advantages of the instant invention will become more apparent from the detailed description thereof taken with the accompanying drawings.

DESCRIPTION OF THE PREFERRED EMBODIMENT

Figure 1:
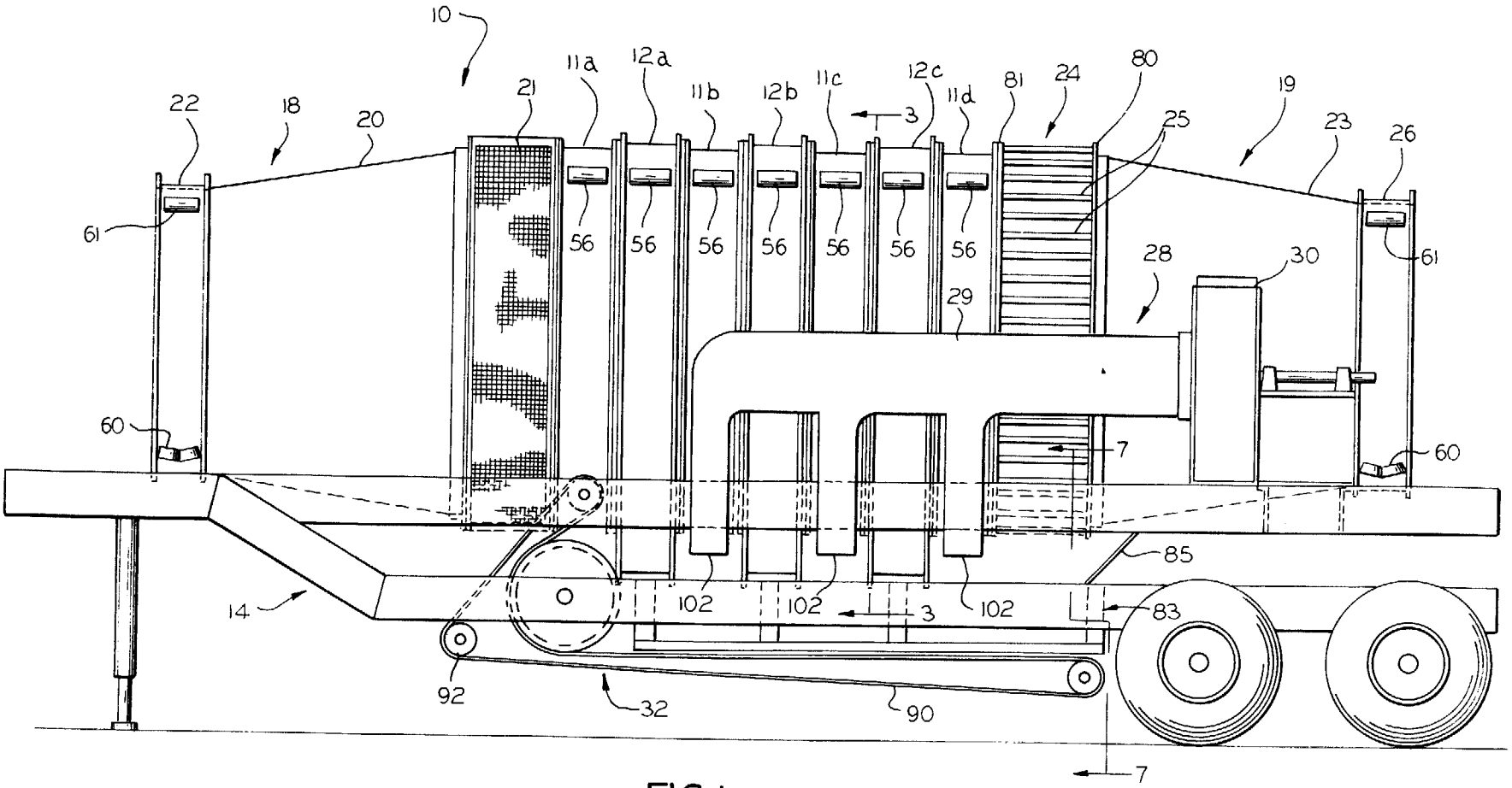
FIG. 1 is a side elevational view of the apparatus according to the invention.
Figure 2:
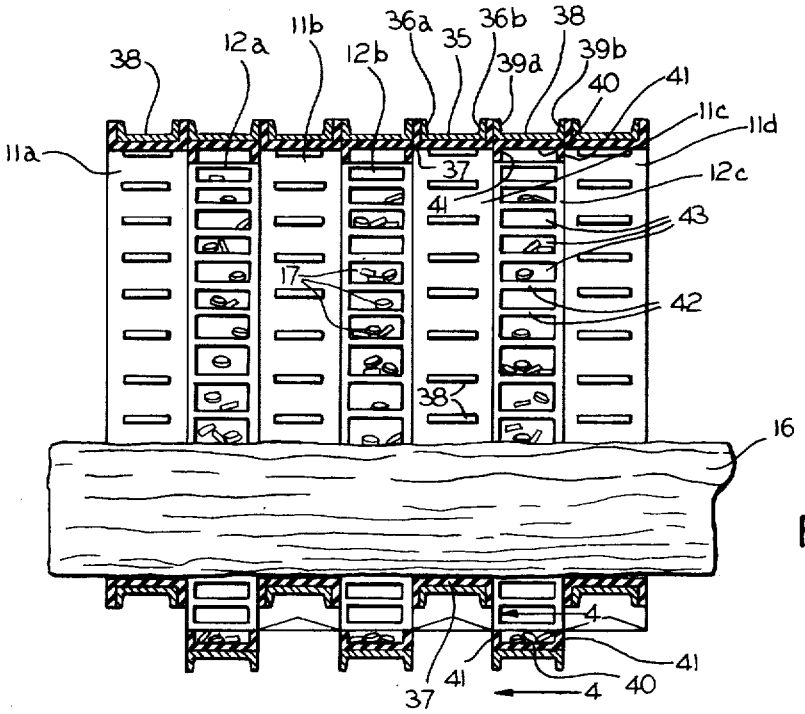
FIG. 2 is a sectional view of a portion of the apparatus.

FIG. 1 shows the apparatus of the invention generally to include a first plurality of cylindrical sections 11*a*, 11*b*, 11*c*, and 11*d* and interposed larger diameter cylindrical sections 12*a*, 12*b*, and 12*c*. As will be discussed more fully hereinbelow, each of the cylindrical sections 11*a*–11*d* and 12*a*–12*c* are independently mounted for rotation on a suitable support which may comprise, for example, a flat bed trailer 14 with the sections 11*a*–11*d* being rotatable in a first direction and the sections 12*a*–12*c* being rotatable in an opposite direction. In addition, the sections 11*a*–11*d* and 12*a*–12*c* are each open-ended and interface one with the other to provide a continuous flow path therethrough for logs 16 and impact objects 17. Also, as will be discussed more fully hereinbelow, the smaller diameter cylindrical sections 11*a*–11*d* are generally coaxial with each other while the cylindrical sections rotate about axes which are at a higher elevation than those of sections 12*a*–12*c* so that as seen in FIGS. 1 and 2 the lower periphery of the cylindrical sections 11*a*–11*d* are elevated above the lower peripheral portions of the larger diameter sections 12*a*–12*c*. As a result, a log 16 being debarked will be supported by the smaller diameter sections 11*a*–11*d* while the impact objects 17 will tend to fall toward the lower ends of the larger diameter sections 12*a*–12*c*.

As indicated above, the cylindrical sections 11*a*–11*d* and 12*a*–12*c* are open-ended and interfaced with each other to provide a continuous flow path through the apparatus. In addition, an infeed section 18 is disposed at one end of the apparatus and includes a frusto-conical member 20, a cylindrical portion 21 formed of a foraminous material and which couples the large diameter end of the member 21 to the open end of the cylindrical section 11*a* and a flanged nose ring 22 mounted on the small diameter end of member 20. Similarly, a discharge section 19 is disposed at the opposite end of the apparatus and includes a frusto-conical member 23 whose large diameter end is connected to the last rotatable cylindrical section 11*d* through a cylindrical section 24 formed of axially extending spaced apart bars 25 and a nose ring 26 affixed to the small diameter end of member 23. The cylindrical portion 21 of the infeed section 18 interfaces with the first rotating section 11*a* and has substantially the same diameter. The perforated or screenlike material of which portion 21 is formed permits small dirt particles and gravel to pass therethrough. Similarly, the cylindrical outlet portion 24 of discharge section 19 is substantially the same diameter and interfaces with the cylinder section 11*d*. The spaced apart bars 25 of which portion 24 is formed permits the discharge of the impact objects 17 into a recycling system 32 as will be described below. As will also be described more fully below, the infeed section 18 and the discharge section 19 are rotated in the same direction as the cylindrical sections 11*a*–11*d*.

Figure 3:
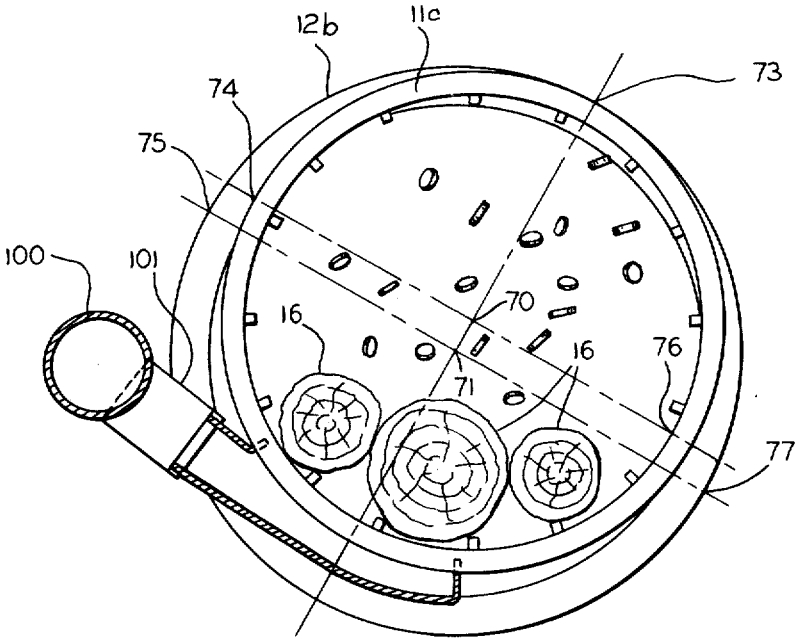
FIG. 3 is a view taken along lines 3—3 of FIG. 1.

An air evacuation system 28 is shown in FIGS. 1 and 3 to be coupled to each of the smaller diameter cylindrical sections 11*b*, 11*c* and 11*d* for providing an air stream to promote the discharge of bark and foreign material from the assembly. The air delivery system 29 includes a duct system 29 coupled to the gap between the unequal diameter cylindrical sections 11*a*–11*d* and 12*a*–12*c* and an outlet coupled to a suction fan 30. A suitable prime mover, not shown, but of a type well known in the art drives fan 30 and also operates the rotational drives for cylindrical sections 11*a*–11*d*, 12*a*–12*c*, a material handling system 32 for receiving the impact objects 17 as they discharge from the cylindrical section 11*d* and for recycling the same to the cylindrical section 11*a*.

Figure 4:
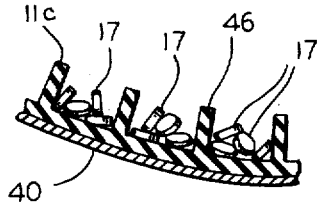
FIG. 4 is a view taken along lines 4—4 of FIG. 2.

Cylindrical sections 11*a*–11*d* are identical to each other and the larger diameter cylindrical sections 12*a*–12*c* are also identical to each other. For the sake of brevity only sections 11*c* and 12*c* will be discussed in detail in relation to FIGS. 2, 4 and 5. More specifically, the cylindrical section 11*c* comprises an outer metallic, cylindrical shell 35 and axial flanges 36*a* and 36*b* disposed at each of the opposite ends. In addition, a lining 37 formed of an elastomeric material, such as rubber is disposed on the interior surface of the shell 35. A plurality of axially extending vanes 38 may be formed on the inner surface of liner 35 to impart rotational motion to the logs 16 or wood sections which may be disposed therein.

The larger diameter cylindrical section 12*c* also includes an outer cylindrical shell 38 and end flanges 39*a* and 39*b* which extend outwardly from the outer surface of the shell 38. A liner 40 is also disposed on the interior surface of shell 38 and is formed of an elastomeric material, such as rubber. The liner 40 is formed with an inwardly extending flange 41 at each end and a plurality of spaced apart partition walls 42 extend axially along the inner surface of liner 40 and between the end flanges 41 to define a plurality of pockets 43 for circulating the impact objects 17 upwardly and for releasing the same for impacting the logs 16 or tree sections being debarked. The elastomeric liners 37 and 40 are provided to reduce noise in the debarking apparatus, to minimize wear and to promote the activity of the impact objects 17 as they resiliently engage and rebound from said liners.

Figure 5:
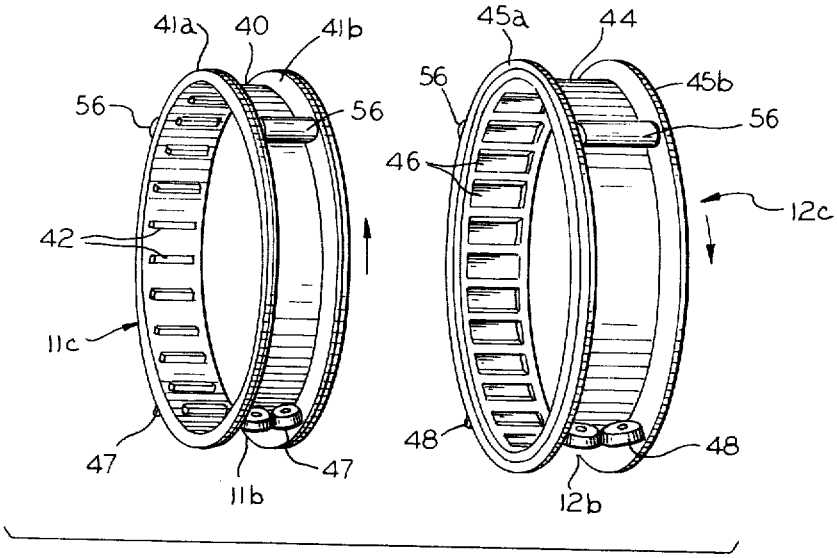
FIG. 5 is an exploded perspective view of a portion of the apparatus.
Figure 6:
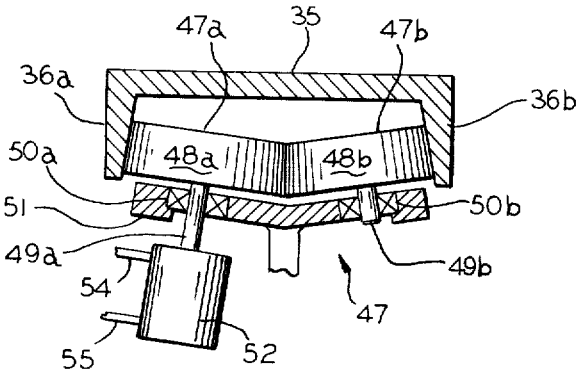
FIG. 6 is a fragmentary view of the drive assembly for one of the cylindrical sections illustrated in FIG. 5.

As seen in FIG. 5, the cylindrical section 11*c* is mounted for counterclockwise rotation as viewed in a downstream direction and about a generally horizontal axis by means of a friction wheel drive assembly 47 which engaged the outer surface of the shell 40. In a similar manner, the section 12*b* is mounted for generally clockwise rotation as viewed in a downstream direction about a generally horizontal axis by means of a friction drive assembly 48 which engages the outer surface of shell 35 and between the flanges 36*a* and 36*b*. It will be appreciated that friction drive assemblies are provided for each of the sections 11*a*–11*d* and 12*a*–12*c* and each may be driven by a common drive assembly or the cylindrical sections may each be driven by an individual motive means to simplify the coupling. In addition, the friction wheel drives may take any convenient form. For example, the drive roller assembly 47 is shown in FIG. 6 to include a pair of frusto-conical friction rollers 47*a* and 47*b* having mating end surfaces 48*a* and 48*b* which are in resilient engagement with each other. A shaft 49*a* extends through and is journaled for rotation in a suitable bearing 50*a* mounted on a bearing support 51 which in turn is supported on trailer 14. The opposite end of shaft 49*a* is coupled to a rotary hydraulic motor 52. Similarly, a shaft 49*b* extends from roller 47*b* through a second bearing mounted on support 51. As those skilled in the art will appreciate, the motor 52 is coupled to a source of fluid pressure through coupling pipes 54 and 55. The peripheral surfaces of the rollers 47*a* and 47*b* will also resiliently engage the inside surfaces of the flanges 36*a* and 36*b* of cylindrical section 35. Accordingly, when suitable fluid pressure is supplied to motor 52 through coupling conduits 54 and 55, the roller 47*b* will rotate thereby also rotating the roller 47*a* and the two will rotate the cylindrical section 35. It will also be appreciated that suitable idler rollers 56 may engage the other sides and the upper ends of the sections 11*a*–11*d* and 12*a*–12*c* to maintain proper alignment and that rollers 56 may be supported on trailer 14 by a suitable support, not shown. The infeed and discharge assemblies 18 and 19 are similarly rotated by drive assemblies 60 which engage the nose rings 22 and 26 and a plurality of suitable idle rollers 61 may also be provided.

Referring now to FIG. 3, it can be seen that the rotational axis 70 of the small diameter section 11*c* is offset upwardly and to the right of the rotational axis 71 of the larger diameter section 12*b*. A continuation of the plane 72 which intersects the rotational axes 70 and 71 of the cylindrical sections 11*c* and 12*b* also intersects a line 73 which is substantially tangent to the two sections. Each of the cylindrical sections 11*a*–11*d* and 12*a*–12*c* are all tilted about a series of axes parallel to the line 72 shown in FIG. 3 such that their upper ends move forwardly and their lower ends move rearwardly relative to the direction of flow of the material through the apparatus. As a result, the sections 11*a*–11*d* and 12*a*–12*c* each rotates about parallel, but not coincident axes.

The points of greatest forward tilt of the sections 11*b* and 11*c* will be 90° clockwise around its respective rotational axis and from the tangent line 73, or in other words, the point 74 for section 11*c* and 75 for section 12*b*, respectively. Similarly, the points of greatest rearward displacement of cylindrical sections 11*c* and 12*b* are points 76 and 77, respectively. The inlet assembly 18 and the outlet assembly 19 which are respectively coaxial with the smaller diameter sections 11*a* and 11*d* and are similarly oriented. While the degree of forward tilt of the cylindrical sections 11*a*–11*d* and 12*a*–12*c* and of the inlet and outlet assemblies 18 and 19 will be a matter of design preferance, a tilt of about 7°–10° along lines 74–76 and 75–77 will provide the desired rate of migration of log or tree sections and impacting objects through the apparatus.

Figure 7:
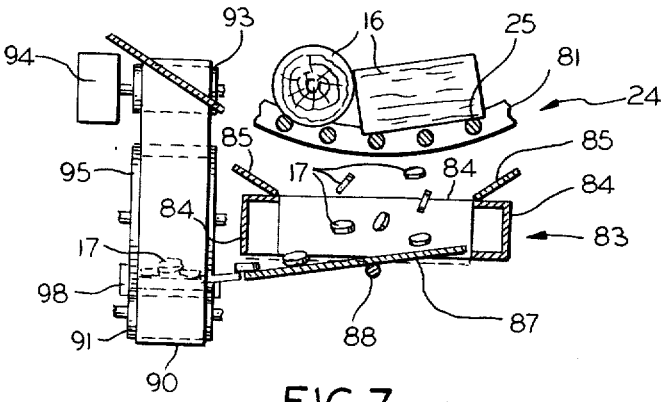
FIG. 7 is a view taken along lines 7—7 of FIG. 1.

As indicated above, the cylindrical discharge section 24 is composed of a plurality of axially extending, spaced apart bars 25 which extend between a flange 80 integral with the large diameter end of frusto-conical member 23 and a ring 81 which defines the upstream end of section 24 and which interfaces with the open end of cylindrical section 11*d*. Disposed below the section 24 as seen in FIG. 7, is an impact object receptacle 83 consisting of generally vertical side walls 84 and upwardly inclined deflector plates 85 for directing impact objects 17 which fall between the bars 25 downwardly into the receptacle 83. The bottom of receptacle 83 is defined by a tiltable bottom pan 87 which may be selectively pivoted about pin 88 between a position shown by broken lines in FIG. 7 wherein the same closes the lower end of receptacle 83 and a position shown by full lines wherein it is inclined downwardly for directing the impact objects to the recycle assembly 32.

Figure 8:
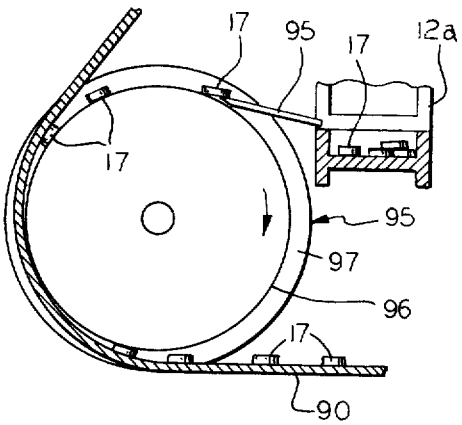
FIG. 8 is an enlarged view of a portion of the recycle assembly of the apparatus shown in FIG. 1.

As seen in FIGS. 2, 7 and 8 the recycle assembly 32 includes an endless belt 90 which extends around rollers 91, 92 and 93, one of which may be a drive roller and the other two idlers. For example, a hydraulic motor 94 is shown in FIG. 7 to be coupled for driving roller 93. It will be appreciated that the rollers 91, 92 and 93 may be suitably journaled for rotation on trailer 14 by means not shown and that hydraulic motor 94 may be coupled to a suitable pump, not shown, and which is suitably driven from the prime mover (not shown) in a manner well known in the art. The belt 90 also passes around a recycle wheel 95 which has a center drum 96 around which the belt 90 extends and a pair of side flanges 97 which engage the sides of said belt. The recycle wheel 95 is journaled for rotation by belt 90 so that its peripheral speed is substantially the same as the linear speed of belt 90.

It will be appreciated with reference to FIG. 7 that when the pan 87 is in its inclined position, the impact objects 17 which migrate through the apparatus and from the cylindrical section 11*d* to the discharge portion 24, will fall through the bars 25, slide down the pan 87 and unto the upper surface of belt 90, a deflector 98 at the far side of belt 90 relative to pan 87 prevents the objects 17 from rolling off of said belt.

Referring again to FIG. 8, the impact objects 17 are shown to be carried along the upper surface of the belt 90 and moved into engagement with the drum 93 where they are held in resilient engagement therewith as the wheel 95 rotates and until the objects 17 approach the upper extremity of the drum 96. At the point where the drum and the belt 90 part, the rotation of the wheel 95 carries the objects 17 along the clockwise direction as viewed in FIG. 8 until they move onto a downwardly inclined deflector 99 which extends into the open end of the first large diameter section 12*a*.

The air evacuation system 28 is shown in FIGS. 1 and 3 to include a duct 29 consisting of a main section 100 which extends from the fan 30 in a direction generally parallel to the rotational axes of the cylindrical segments 11*a*–11*d* and 12*a*–12*c*. A plurality of branch ducts 101 which extend downwardly from the duct 100 and to a pan 102 which is disposed below the small diameter sections 11*b*, 11*c* and 11*d*. Each pan 102 has open sides presented to the large diameter sections 12*a*, 12*b* and 12*c*. In addition, the internal surface of the pans 102 may have a center peaked portion to prevent the cascading impact objects 17 from collecting therein. The heavier impact objects and the lighter bark, leaves and other debris will tend to fall into the lower ends of the large diameter sections 12*a*–12*c*. The action of the suction fan will create an outdraft through the gap between the lower ends of sections 12*a*–12*c* as indicated by arrows 104 and which is sufficiently strong to carry the lighter material into the air system 32 for discharge by fan 30.

In operation of the apparatus, the cylindrical sections 11*a*, 11*b*, 11*c* and 11*d* and the end sections 18 and 19 are rotated in a first direction and the large diameter sections 12*a*, 12*b* and 12*c* in an opposite direction by individual hydraulic motors, such as motor 52 shown in FIG. 6, and which are operated from a common pump (not shown). In addition, the hydraulic motor 94 (FIG. 7) is actuated to commence moving the belt 90 and rotating the recycle wheel 95 in a clockwise direction as viewed in FIG. 8. In addition, the suction fan 30 is actuated to begin drawing air from within the rotating sections 11*a*–11*d* and 12*a*–12*c* through the sides of the large diameter sections 12*a*, 12*b* and 12*c* around the baffles 103, through the pans 102 into the branch ducts 101, the main duct 100 and outwardly through the suction fan 30. One or more logs 16 or a plurality of smaller wood sections are fed into the apparatus through the infeed assembly 18. A plurality of impact objects 17 will have previously been disposed within the large diameter sections 12*a*, 12*b* and 12*c* and particularly section 12*a*. As a result of the rotation of the inlet section 18 and its forward tilt, as discussed hereinabove, the logs 16 and/or smaller wood sections will begin migrating toward the first small diameter section 11*a* which will initially engage the logs and continue their movement downstream of the apparatus. When the lead end of the log is engaged by the section 11*a*, the lugs 38 formed on the interior surface of said section will begin rotating the log as it progresses downstream. Meanwhile, the impact objects 17 will be raised upwardly within the pockets 43 formed in the large diameter sections 12*a* and be carried thereby upwardly as these sections rotate. It will be appreciated that the height to which the objects 17 are raised within the cylindrical sections 12*a*, 12*b* or 12*c* will be dictated by the speed of rotation. It will be appreciated that the speed of sections 12*a*–12*c* should be sufficiently great to carry the objects toward the upper end of the apparatus but less than the critical speed which would tend to hold the impact objects within the pockets 43. Approximately 70% of this critical centrifugal speed is satisfactory. The impact objects 17 should generally have a density several times greater than that of the logs being debarked.

As the logs 16 progress downstream, the lead ends thereof will soon pass into the larger diameter section 12*a* but will be supported in an elevated position with respect thereto by the smaller diameter section 11*a* and the infeed assembly 18. The cascading impact objects 17 will begin delivering generally uniform and randomly distributed surface impacts and abrasions on the log 16 as the latter is rotated by the lugs 38 in the smaller diameter section 11*a*. If the unit energy of each impact lies above a critical level determined by the wood specie and condition, the gradual and uniform degrading of the bark structure occurs whereby the bond between the bark and the wood is ultimately weakened and that the bark is soon stripped away.

As a result of the slight tilt of the cylindrical sections 11*a*–11*d* and 12*a*–12*c*, the log 16 and the impact objects 17 will tend to migrate downstream toward the discharge assembly 19 while the debarking process continues as incremental portions of the log 16 move downstream through the rotating cylindrical sections. The continued random impacts of the objects 17 on the log 16 will eventually remove all of the bark. It will also be appreciated that because the small diameter sections 11*a*–11*d* and the large diameter sections 12*a*–12*c* are independently rotatable, the speed of migration of the log 17 downstream of the apparatus, as determined by the speed of the small diameter sections 11*a*–11*d*, is independent of that speed of rotation of the large diameter sections 12*a*, 12*b* and 12*c* which is necessary in order to sufficiently elevate the impact objects 17 without exceeding the critical centrifugal speed. As the bark is thus removed, the air blast created by the suction fan 30 tends to discharge the dislodged bark from the system where it may be conveniently collected and disposed of. In addition, as the impact objects 17 reach the cylindrical discharge chamber section, they will fall through the bars 25 for being recycled by the assembly 32.

It will be appreciated also that as the logs 16 or other wood sections enter the infeed assembly 18, loose dirt, gravels and other foreign particles will tend to be dislodged and fall through the screen or perforation which form the sides of the inlet cylindrical section 20. Other loose debris and leaves are collected by the air discharge system 28 as indicated above.

It will be appreciated from the foregoing that the system according to the invention provides a continuous debarking process and apparatus wherein the logs 16 or other wood sections are delivered to one end of the system and debarked logs delivered from the other end while the impact objects 17 are circulated. While four small diameter sections 11*a*–11*d* and three large diameter sections 12*a*–12*c* are illustrated, it will be appreciated that the number of each and their length can vary with the size of the logs to be debarked, the number of impacts necessary to debark a particular log, the desired system capacity and the speed that the wood sections migrate through the system, the latter of which is also dependent, to some extent, upon the angle of tilt of the cylindrical sections and the speed of the small diameter sections 11*a*–11*d*.

While the invention has been discussed generally with respect to the debarking of logs, it will be appreciated that smaller size wood sections or tree limbs, such as those shown in FIG. 7, may be debarked as well. These smaller wood sections may vary in length to a substantial degree, it being appreciated, however, that smaller tree limb sections having a length shorter than the distance between the smaller diameter sections 11*a*–11*d*, will tend to fall within the large diameter sections and tumble along with the impact objects 17. This action, however, will also cause debarking as a result of random impacts by the objects 17. As a result, the same apparatus can be employed for debarking both logs and tree limb or top segments. It can also be seen that as the impact objects 17 migrate through the system they will pass through the small diameter sections 11*b*, 11*c* and 11*d* although the ribs 38 on the sides of said section will generally be insufficient to raise them more than a small vertical distance after which they will tend to tumble back into one of the adjacent large diameter sections 12*a*, 12*b*, or 12*c*.

The continuous process illustrated permits the debarking of wood sections without sorting or recycling and permits total debarking while maintaining the entrance to exit distance relatively short. For many species of wood, there is a definite difference between the bark breakdown energy and the wood breakdown energy. The action within the debarking apparatus consists of selective abrading, crushing and shearing of the bark in preference to the wood fiber. This preferential action is enhanced by the fact that most bark is normally more brittle than the wood it is associated with and hence more susceptible to impact crushing. If the elevation to which the impact objects are raised is such that the energy level at the point of impact with the various logs 16 or other wood sections is somewhere between the two critical energy levels, suitable rapid destruction of the bark will occur with relatively little damage to the wood. Also, because the process exposes the surface of the wood pieces or logs to uniformly distributed energy delivery, the roundness and symmetry is not important and shape becomes relatively insignificant. Irregularly shaped wood pieces and logs with small extending branch limbs may be efficiently debarked with very little loss of wood fiber. Effective debarking can therefore be achieved regardless of size and shape of logs or tree sections.

The size, shape, hardness and density of the impact objects may vary widely. Examples of insatisfactory impacting objects are mild steel slugs having generally cubicle cylindrical or disk-like shapes about one to two cubic inches in volume. Also, typical ceramic or metallic material used in ball mills or even stone or crushed rock may be employed.

The debarked wood produced in the apparatus according to the invention will generally be sufficiently clean for chipping into wood pulps or flaking for particle board use. The structure according to the invention provides an efficient and economical apparatus for debarking logs and which may also be employed for debarking tree limbs and tree top sections which are now normally discarded. This not only provides an economical use for such tree sections but also allows the use of trees which were heretofore not suitable because of size or shape.

Those skilled in the art will appreciate that the apparatus and method according to the invention may also be applied for the removal of any undesired matter from logs or wood sections. For example, plaster could be removed from wood salvage from demolished buildings, rock or ice removed from log sections and bark from sawmill slabs.

While only a single embodiment of the invention has been disclosed and described, it is not intended to be limited thereby but only the scope of the appended claims.

I claim:

1. Apparatus for debarking wood sections comprising, a plurality of individually rotatable, hollow and interconnected housing sections defining an impact zone, said sections each being mounted for rotation about gennerally horizontal axes, drive means for simultaneously rotating a first group of said housing sections in a first direction and a second group of said housing sections in an opposite direction, a plurality of unconnected impact means each having higher specific gravity than the wood sections to be debarked and being disposed within said impact zone, and means disposed on the internal surface of at least some of said housing sections for elevating said plurality of impact objects within said impact zone a distance substantially above the axis of rotation of said housing section and for releasing the same for random impacting engagement with the wood sections whereby the bark on said sections is removed.

2. The apparatus set forth in claim 1 wherein said housing sections are generally cylindrical and the internal diameter of said first group of housing sections are larger than the internal diameter of said second group of housing sections.

3. The apparatus set forth in claim 2 wherein said first and second groups of housing sections are arranged in an alternating relation.

4. The apparatus set forth in claim 3 wherein said first and second groups of housing sections are arranged such that the lowermost point on the internal surface of said first group of housing sections is elevated relative to the lowermost point on the second group of housing sections such that logs extending axially of said housing sections will be supported by said first group of housing sections.

5. The apparatus set forth in claim 4 wherein said drive means includes means for rotating said first and second groups of housing sections at different rotational speeds.

6. The apparatus set forth in claim 5 wherein a separate drive means is coupled to each of said housing sections.

7. The apparatus set forth in claim 6 wherein said means for moving said plurality of impact objects upwardly relative to said housing sections are disposed on the internal surface of said second group of housing sections.

8. The apparatus set forth in claim 7 and including inlet means disposed adjacent one end of said plurality of housing sections for directing wood sections into said impact zone and discharge means for receiving debarked wood section from the last of the housing sections defining said impact zone.

9. The apparatus set forth in claim 8 wherein the upper end of each of said housing sections is tilted forwardly in the direction of the discharge means to permit migration of said impact objects and wood sections through said impact zone.

10. The apparatus set forth in claim 9 wherein said first and second plurality of housing sections are generally tangent at a point above the rotational axis of said sections and offset to one side of a vertical plane passing through the rotational axis of at least one of said plurality of housing sections, the rotational axis of said second plurality of housing sections lying in a second plane passing through said tangent point and the rotational axis of said first plurality of housing sections.

11. The apparatus set forth in claim 10 wherein each of said housing sections is tilted about one of a series of parallel axes lying in said second plane.

12. The apparatus set forth in claim 11 wherein said inlet and discharge means are rotatable in the same direction as said first group of said housing portions.

13. The apparatus set forth in claim 12 wherein said inlet and discharge means are generally conical and rotate in the same direction as said first group of housing sections.

14. The apparatus set forth in claim 13 where said inlet means includes a generally cylindrical portion substantially co-radial with said first plurality of housing sections and being generally foraminous.

15. The apparatus set forth in claim 14 and including recycling means for receiving the impact objects discharging from the last of said plurality of housing sections and for recycling said impact objects to the first of said second plurality of housing sections.

16. The apparatus set forth in claim 15 wherein said discharge means includes a generally cylindrical portion which is substantially co-radial with said first plurality of housing sections and having a plurality of gaps formed therein, said recycling means includes collecting means disposed below said discharge cylindrical portion for collecting said impact objects and delivering the same to said recycling means.

17. The apparatus set forth in claim 16 and including air evacuation means coupled to at least some of said housing sections for withdrawing dislodged bark and foreign material from said impact zone.

18. The apparatus set forth in claim 1 wherein said first and second groups of housing sections are arranged in an alternating relation.

19. The apparatus set forth in claim 18 wherein said first and second groups of housing sections are arranged such that the lowermost point on the internal surface of said first group of housing sections is elevated relative to the lowermost point on the second group of housing sections such that logs extending axially of said housing sections will be supported by said first group of housing sections.

20. The apparatus set forth in claim 1 wherein said means for moving said plurality of impact objects upwardly relative to said housing sections comprises a plurality of axially extending means disposed on the internal surface of said second group of housing sections for engaging said impact objects and carrying the same upwardly as said sections rotate.

21. The apparatus set forth in claim 1 and including inlet means disposed adjacent one end of said plurality of housing sections for directing wood sections into said impact zone and discharge means for receiving debarked wood sections from the last of the housing sections defining said impact zone.

22. The apparatus set forth in claim 21 wherein said inlet and discharge means are hollow and rotatable in the same direction as said first group of housing sections, said inlet and outlet means each including a generally conical portion.

23. The apparatus set forth in claim 22 where each of said inlet and discharge means include a generally cylindrical portion substantially co-radial with said first plurality of housing sections, said inlet cylindrical section being generally foraminous.

24. The apparatus set forth in claim 23 and including recycling means for receiving the impact objects discharging from the last of said plurality of housing sections and for recycling said impact objects to the first of said second plurality of housing sections, said discharge means includes a generally cylindrical portion which is substantially co-radial with said first plurality of housing sections and having a plurality of gaps formed therein, and including collecting means disposed below said discharge cylindrical section for collecting said impact objects and delivering the same to said recycling means.

25. The apparatus set forth in claim 1 wherein the upper end of each of said housing sections is tilted forwardly toward one end of said impact zone to permit migration of said impact objects and wood sections through said impact zone.

26. The apparatus set forth in claim 25 wherein said first and second plurality of housing section are generally tangent at a point above the rotational axis of said sections and offset to one side of a vertical plane passing through the rotational axis of at least one of said plurality of housing sections, the rotational axis of said second plurality of housing sections lying in a second plane passing through said tangent point and the rotational axis of said first plurality of housing sections.

27. The apparatus set forth in claim 26 wherein each of said housing sections is tilted about one of a series of parallel axes lying in said plane.

28. The apparatus set forth in claim 1 wherein said drive means includes means for rotating said first and second groups of housing sections at different rotational speeds.

29. The apparatus set forth in claim 28 wherein a separate drive means is coupled to each of said housing sections.

30. The apparatus set forth in claim 1 wherein each of said housing sections comprises a metallic shell having a lining formed of an elastomeric material.

31. Apparatus for debarking wood sections comprising, a plurality of individually rotatable, hollow, generally cylindrical and interconnected housing sections defining an impact zone, said sections each being mounted for rotation about generally horizontal axes, means for rotating a first group of said housing sections in a first direction and a second group of said housing sections in an opposite direction and at a different speed, the lower peripheries of said first group of housing sections being elevated relative to the lower peripheries of said second group of housing sections to support elongate wood sections in said elevated position, a plurality of unconnected impact objects each having higher specific gravity than the wood sections to be debarked and being disposed within said impact zone, and being substantially smaller than the width of said housing sections, the housing sections of said groups being arranged in an alternate relation, means disposed on the internal surface of at least some of said second group of housing sections for elevating said plurality of impact objects within said impacting zone a distance substantially above the axis of rotation of said housing section and for releasing the same for random impacting engagement with the wood sections whereby the bark on said sections is removed.

32. A method for removing undesirable material from wood sections comprising the steps of:

providing a plurality of alternate support zones and impact zones, said zones being interconnected to provide a continuous flow path, introducing wood sections to be debarked into said flow path and progressively transporting said wood sections through said flow path while simultaneously reorienting said wood sections to continuously expose different surfaces thereof to the upper portions of said impacting zones, continuously elevating in each of said impacting zones a plurality of objects and releasing said objects in said zones to impact with those portions of the wood sections between said support zones for delivering random high energy impacts with said wood sections for removing bark therefrom, said impact objects having a density substantially higher than that of the wood being debarked and being substantially smaller in size.

33. The method set forth in claim 32 wherein the distance across said impact zones and between said support zones is less than the length of the wood sections to be debarked and supporting said wood sections in said support zones at a higher elevation than the lower peripheries of said impact zone whereby said impact objects tend to collect in lower peripheries of said impact zones.

34. The method set forth in claim 33 wherein said impact zones and said support zones are each defined by independently rotatable cylindrical sections, and including the steps of rotating said cylindrical sections defining said impact zones in a first direction to elevate said impact objects toward the upper periphery of said zone, said rotational speed being less than the speed which would hold said impact objects against said rotating cylindrical sections by cylindrical force, and rotating said cylindrical sections defining said support zones in an opposite direction to rotate said wood sections being debarked.

* * * * *

UNITED STATES PATENT OFFICE
CERTIFICATE OF CORRECTION

Patent No. 3,955,608 Dated May 11, 1976

Inventor(s) Ralmond J. Smiltneek

It is certified that error appears in the above-identified patent and that said Letters Patent are hereby corrected as shown below:

Claim 8, Column 9, Line 1, "section" should be --sections--.

Claim 26, Column 10, Line 32, "section" should be --sections--.

Claim 31, Column 11, Line 9, "section" should be --sections--.

Claim 33, Column 12, Line 12, "zone" should be --zones--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*